US008756750B2

(12) United States Patent
Shih

(10) Patent No.: US 8,756,750 B2
(45) Date of Patent: Jun. 24, 2014

(54) MOP WRINGER

(71) Applicant: Feng-Ming Shih, Taichung (TW)

(72) Inventor: Feng-Ming Shih, Taichung (TW)

(73) Assignee: Da Ding Energy Co., Ltd., Taichung (TW)

( * ) Notice: Subject to any disclaimer, the term of this patent is extended or adjusted under 35 U.S.C. 154(b) by 0 days.

(21) Appl. No.: 13/918,371

(22) Filed: Jun. 14, 2013

(65) Prior Publication Data

US 2013/0333152 A1 Dec. 19, 2013

(30) Foreign Application Priority Data

Jun. 18, 2012 (TW) ..... 101211684 A

(51) Int. Cl.
*A47L 13/58* (2006.01)

(52) U.S. Cl.
USPC ..... 15/263; 15/260

(58) Field of Classification Search
USPC ..... 15/260, 263
See application file for complete search history.

(56) References Cited

U.S. PATENT DOCUMENTS

| | | | | |
|---|---|---|---|---|
| 7,243,392 | B2 * | 7/2007 | Demirtas | 15/260 |
| 8,327,502 | B2 * | 12/2012 | Tsai | 15/260 |
| 2002/0112311 | A1 * | 8/2002 | Ho | 15/263 |

* cited by examiner

*Primary Examiner* — Randall Chin
(74) *Attorney, Agent, or Firm* — Egbert Law Offices, PLLC

(57) ABSTRACT

A mop wringer is attached to an existing bucket, and the bucket is further provided with a driving device. The driving device includes a driving piece and a guide piece, to guide the mop wringer to twist and dry the cloth straps of the mop tip. Said mop wringer includes a fixing seat, attached to part of or the whole top end of the bucket. A mop tip inserting portion is formed as a hollow space across one part of the fixing seat, for the mop tip to insert into and join with. A rotary disc is provided on the bottom of the bucket and connected to the guide piece of the driving device. A wringing portion is formed as a ring and connected between the fixing seat and the rotary disc, including an upper open end, a lower open end a periphery and a mop holding space.

7 Claims, 8 Drawing Sheets

(a)

(b)

MOP WRINGER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a mop wringer, and more particularly to an innovative structure which dries the mop by means of twisting.

2. Description of Related Art Including Information Disclosed Under 37 CFR 1.97 and 37 CFR 1.98

A mop is often used as a tool to clean the floor. Daring usage, it has to be washed and cleaned from time to time, and the user has to us his/her hands to mist and dry it. Such a method is not only time-consuming and unsanitary, but also may cause discomfort due to continuous and repetitive twisting by the hands. It may even cause permanent injury to elderly people. To solve the aforementioned problems, some manufacturers have developed a kind of centrifugal dewatering bucket to replace the manual twisting and drying.

However, in operating the prior-art centrifugal dewatering bucket, the mophead is put into the dewatering basket, and the dewatering basket is rotated to and fro to cause a centrifugal force to toss out the water and dry the mop. Such a structure can avoid using the hands to twist and dry the mop, but some problems and shortcomings are also observed, during actual applications. Firstly when a consumer wants to buy a centrifugal dewatering bucket, he/she must at the same time buy the special mop provided by the manufacturer. But as a mop is one of the necessary cleaning tools, usually there is already a conventional mop at home or in the working area. If the consumer has to buy a new mop to use the centrifugal dewatering bucket, it would cause an undesired waste. Moreover, if the special mop is broken, the consumer must go to a special place to buy a new one. This indeed makes a great difficulty for consumers. Secondly, in terms of the structure, as a conventional centrifugal dewatering bucket uses the centrifugal force to toss out the water, it could be easily understood that the cotton cloth straps in the central area of the mophead can not be perfectly dewatered during the rotation. Also, the cotton cloth straps on the tip of the mophead can not be too long or too dense. Otherwise, when the mophead is put into the dewatering basket, the cotton cloth straps will squeeze together to reduce the dewatering effect. As a result, although the conventional centrifugal dewatering bucket can avoid the difficulty in twisting the mop with hands, when cleaning the floor with the special mop, the insufficiency of density and length of the cotton cloth straps will greatly affect the cleaning effect. It is actually not an ideal structure. Therefore, the consumers would usually prefer to use the conventional mop for a better cleaning effect. In consideration of the problems existing in the prior-art structure, an innovative mop dewatering structure suitable for the conventional mops would really be what the consumers are expecting and should indeed become a goal of research and development for the manufacturers.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention has the following enhanced efficacies:

The "mop wringer" disclosed in the present invention provides an innovative structural design wherein said mop wringer comprises a fixing seat, a mop tip inserting portion, a rotary disc and a wringing portion. In contrast to the existing structures described in "prior art", when the mop tip is inserted into the mop tip inserting portion, the cloth straps of said mop tip will be held in the mop holding space of the wringing portion. Then, by controlling the driving device to drive the rotary disc to rotate, causing the wringing portion to be twisted, the mop cloth straps will at the same time be twisted and wrung to dry. Thus, an ideal degree of dryness of the mop can be achieved in a reliable and effective way. Moreover, said mop wringer can universally suit various types of existing mops, and can therefore greatly increase applicability, convenience and versatility.

Although the invention has been explained in relation to its preferred embodiments, it is to be understood that many other possible modifications and variations can be made without departing from the spirit and scope of the invention as hereinafter claimed.

DETAILED DESCRIPTION OF THE INVENTION

Figure 1:
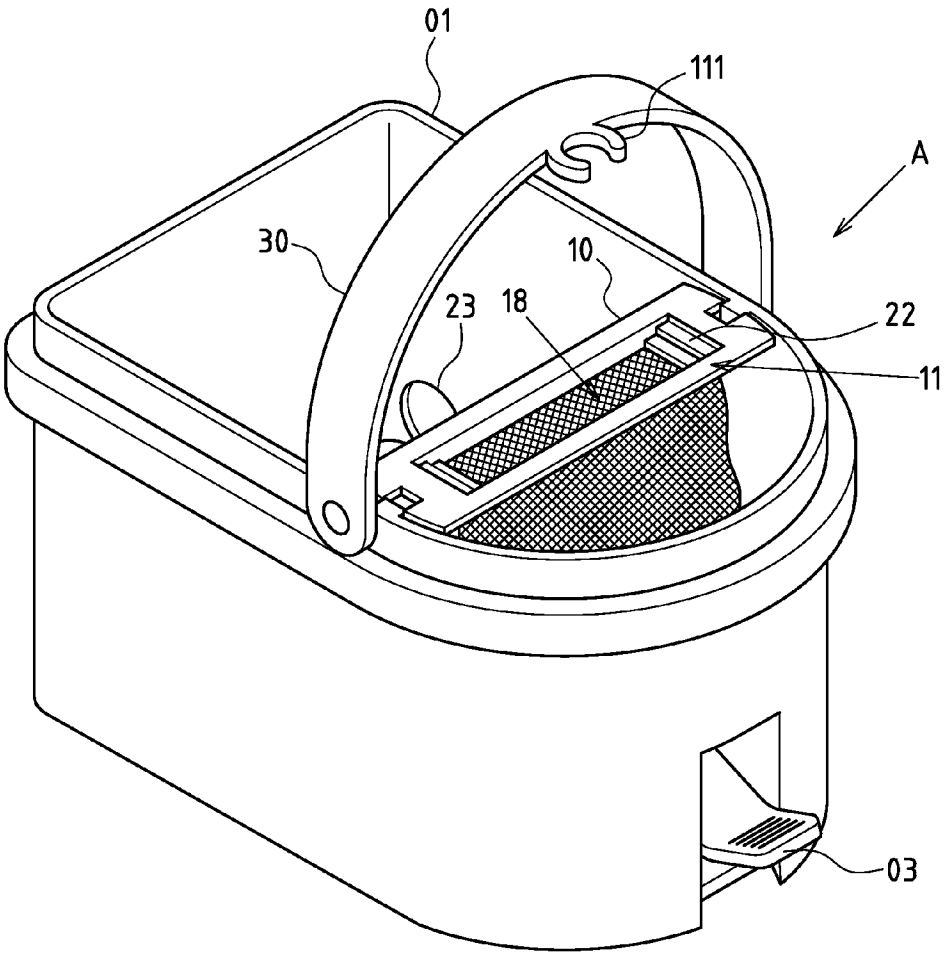
FIG. 1 is an assembled perspective view of the mop wringer and bucket of the present invention.

FIGS. 1-6 depict preferred embodiments of mop wringer of the present invention, which, however, are provided for explanatory purposes only and shall not be intending to limit the patent claims. Said mop wringer A is attached to one position on an existing bucket 01, and a preset position of the bucket 01 is further provided with a driving device 02. The driving device 02 comprises a driving piece 03 and a guide piece 04, to guide the mop wringer A to twist and dry the cloth straps 07 on the tip 06 of the mop 05.

Said mop wringer A comprises a fixing seat 10, attached to part of or the whole top end of the bucket 01. Referring to FIG. 1, the fixing seat 10 is attached to part of the top end of the bucket 01.

A mop tip inserting portion 11 is formed as a hollow space across one part of the fixing seat 10, for the tip 06 of the mop 05 to insert into an join with.

Figure 2:
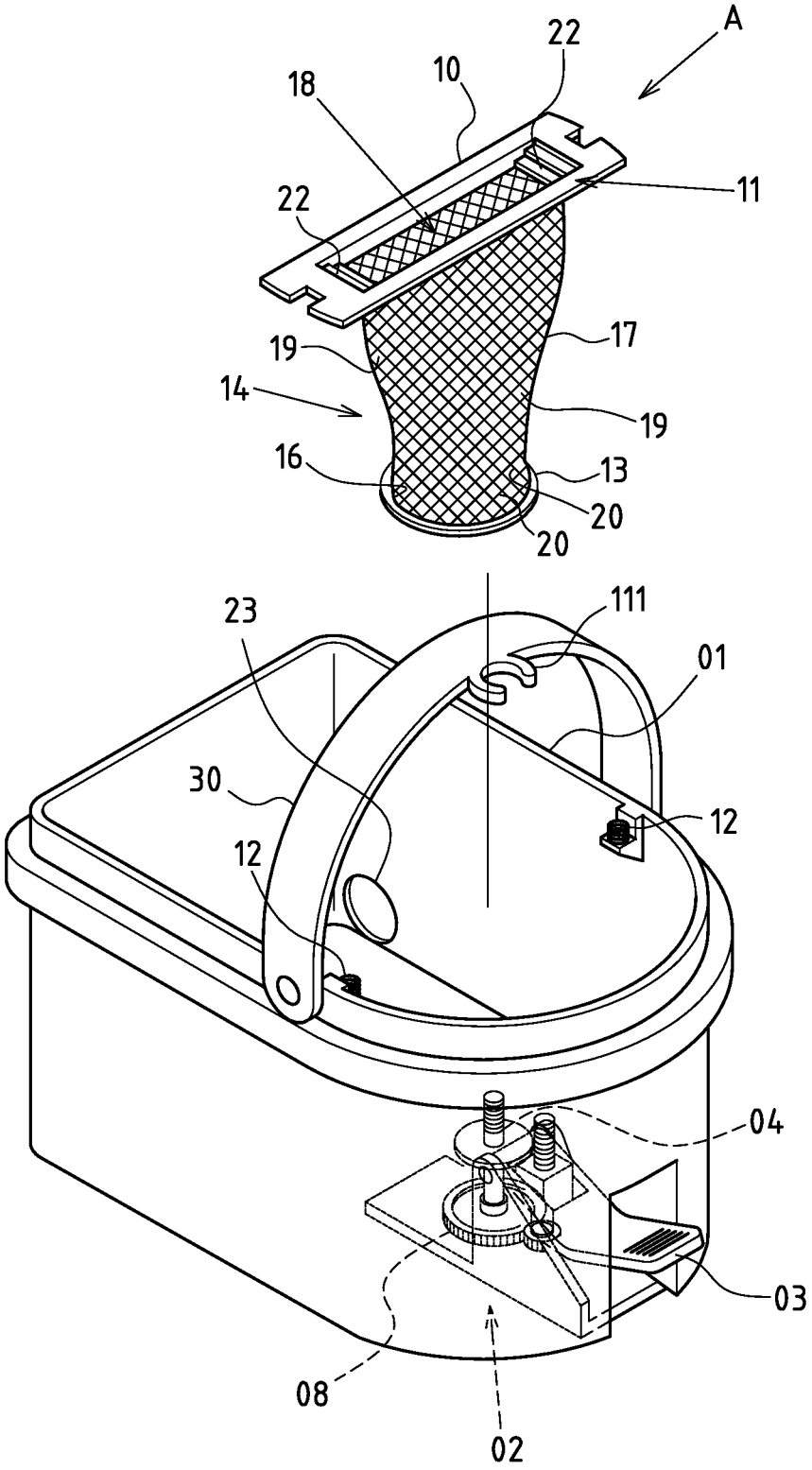
FIG. 2 is an exploded perspective view of the mop wringer and bucket of the present invention.

A rotary disc 13 is provided on the bottom of the bucket 01 and connected to the guide piece 04 of the driving device 02, so that the driving device 02 can control the rotary disc 13 to rotate or stop. Referring to FIG. 2, the driving device 02 further includes a gear transmission assembly 08, so that the driving piece 03 can drive the gear transmission assembly 08 to rotate, and meanwhile drive the guide piece 04 to rotate. Particularly, the gear transmission assembly 08 features a driving relationship wherein a smaller gear drives a bigger gear so as to increase the rotational torque. In this way, the user can operate easily and the rotation speed of the gear transmission assembly 08 can be considerably reduced to enhance safety.

A wringing portion 14 is formed as a ring and connected between the fixing seat 10 and the rotary disc 13. The wringing portion 14 includes an upper open end 15, a lower open end 16, a periphery 17 and a mop holding space 18, wherein the upper open end 15 is connected to the fixing seat 10, while the lower open end 16 is connected to the rotary disc 13. The periphery 17 further includes a plurality of water discharge portions 19.

Figure 4:
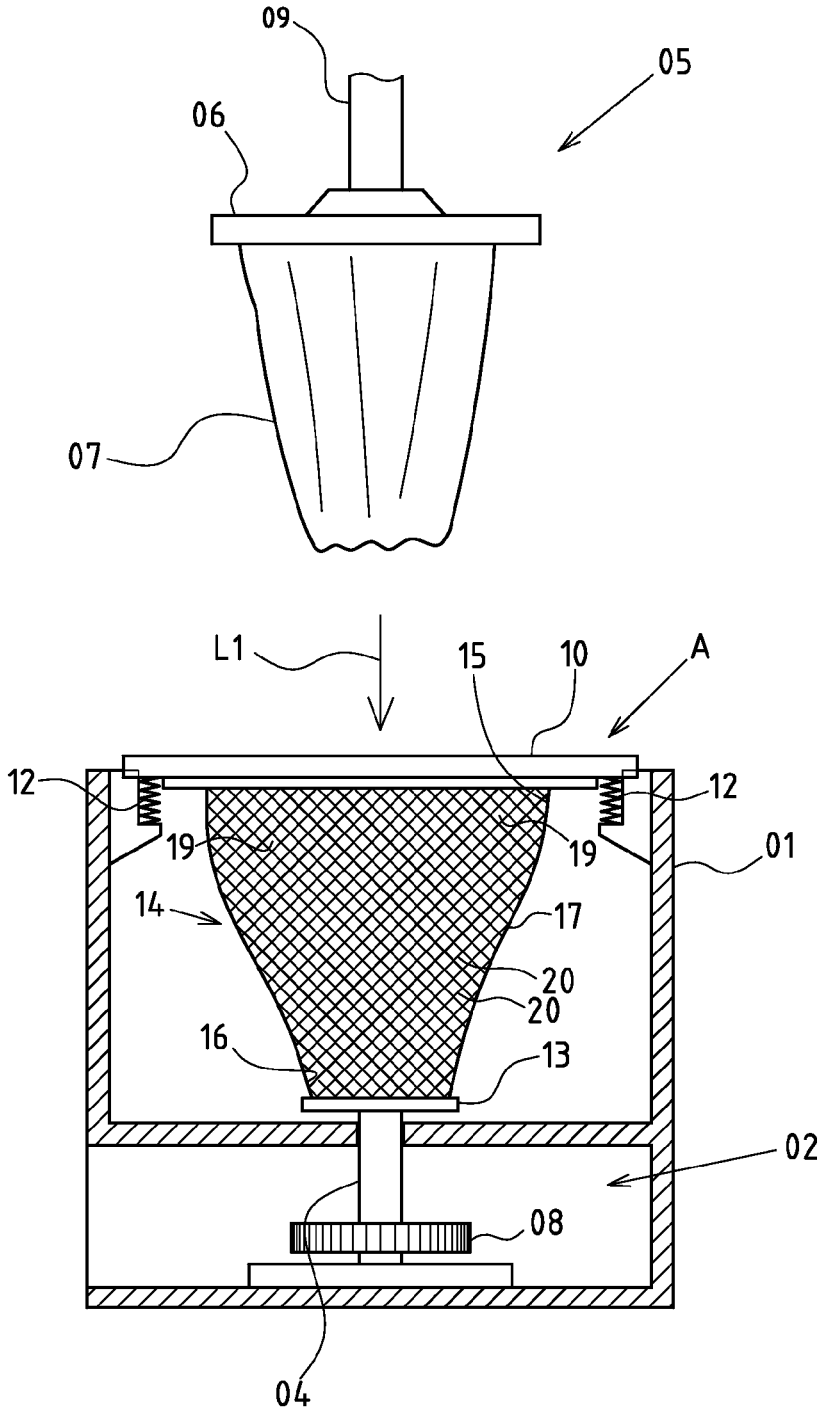
FIG. 4 is an exploded sectional view of the present invention showing the mop to be inserted into the mop wringer.

Referring to FIGS. 2 and 4, the fixing seat 10 and the bucket 01 are connected through an elastic supporting piece 12, so that the fixing seat 10 will be elastically supported upward during normal state.

Figure 8:
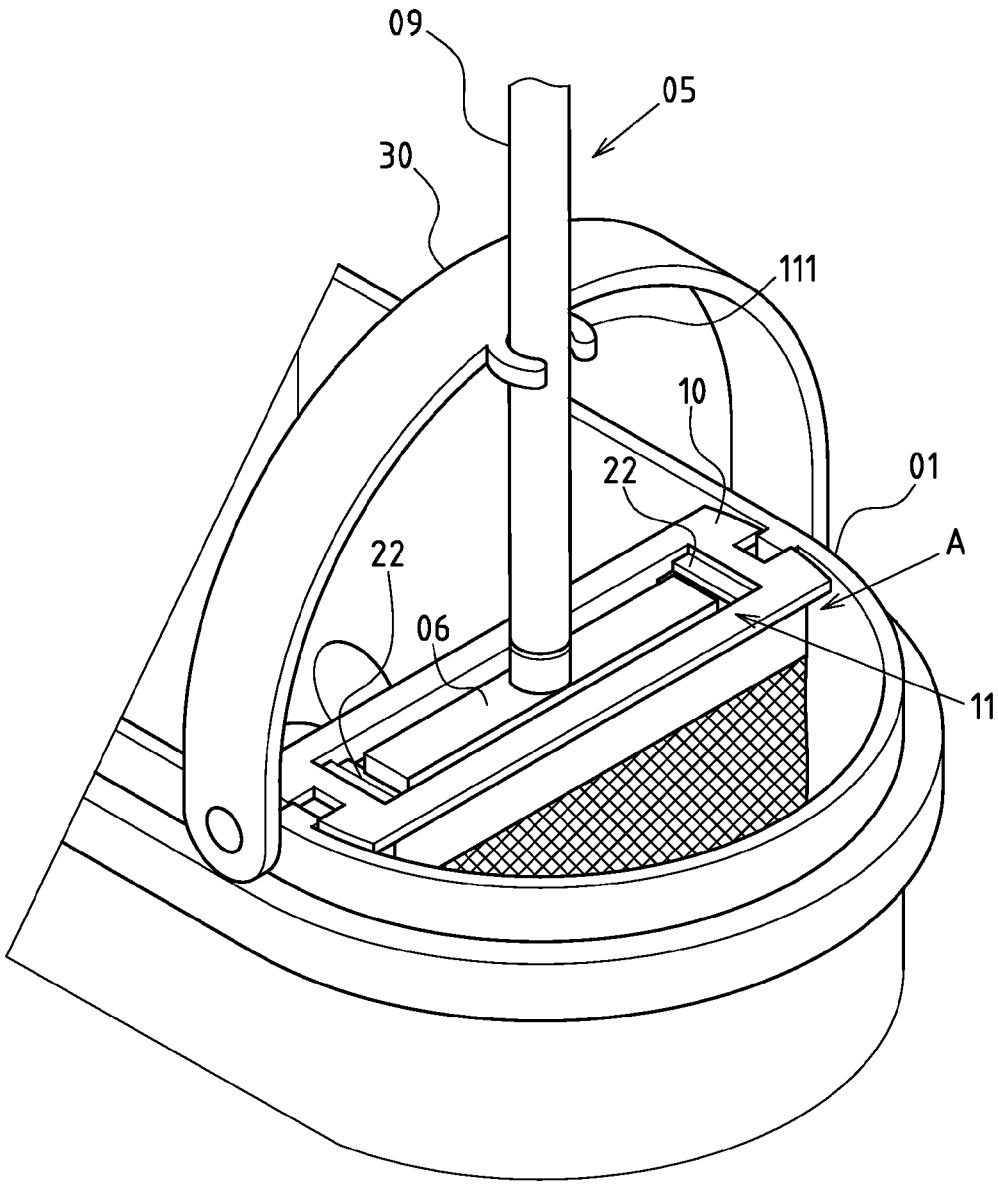
FIG. 8 shows an embodiment of the present invention wherein a snap fastener is further provided on the carrying handle on the top end of the bucket at the position corresponding to the mop tip inserting portion.

Referring to FIG. 8, the top end of the bucket 01 is pivotally arranged with a carrying handle 30, and a snap fastener 111 is further provided on the carrying handle 30 at the position corresponding to the mop tip inserting portion 11, so that, when the mop 05 is inserted into the mop tip inserting portion 11, the holding rod 09 of the mop 05 can be snapped onto the snap fastener 111 of the carrying handle 30, providing a more stable state of the mop 05 during the wringing process.

Referring to FIGS. 2 and 4, the periphery 17 of the wringing portion 14 can be formed as a permeable net made up of criss-cross knitted unit cords 20, and the gaps formed between the unit cords 20 define the water discharge portion 19.

Figure 7:
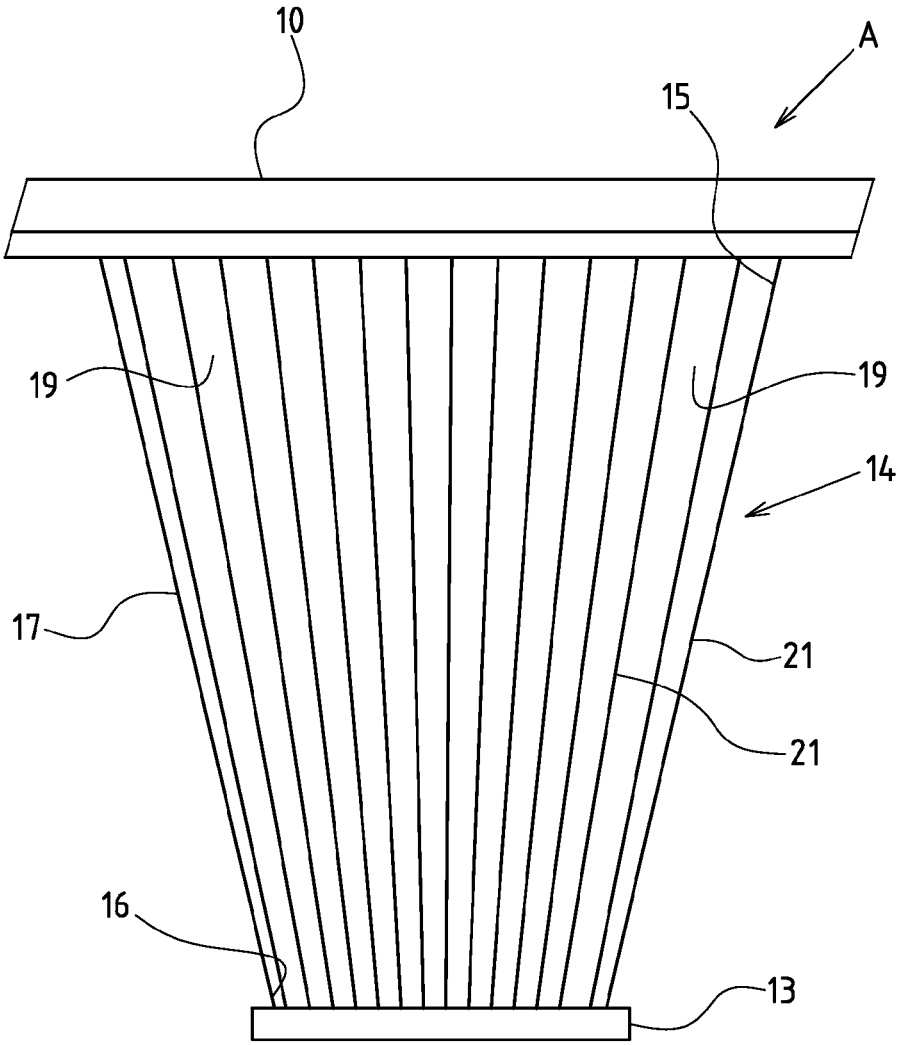
FIG. 7 shows an embodiment of the present invention wherein the periphery of the wringing portion is made up of straps in longitudinal spaced arrangement forming a ring shape.

Referring to FIG. 7, the periphery 17 of the wringing portion 14 is made up of straps 21 in longitudinal spaced arrangement forming a ring shape, and the spaces formed between the straps 21 define the water discharge portion 19.

Figure 3:
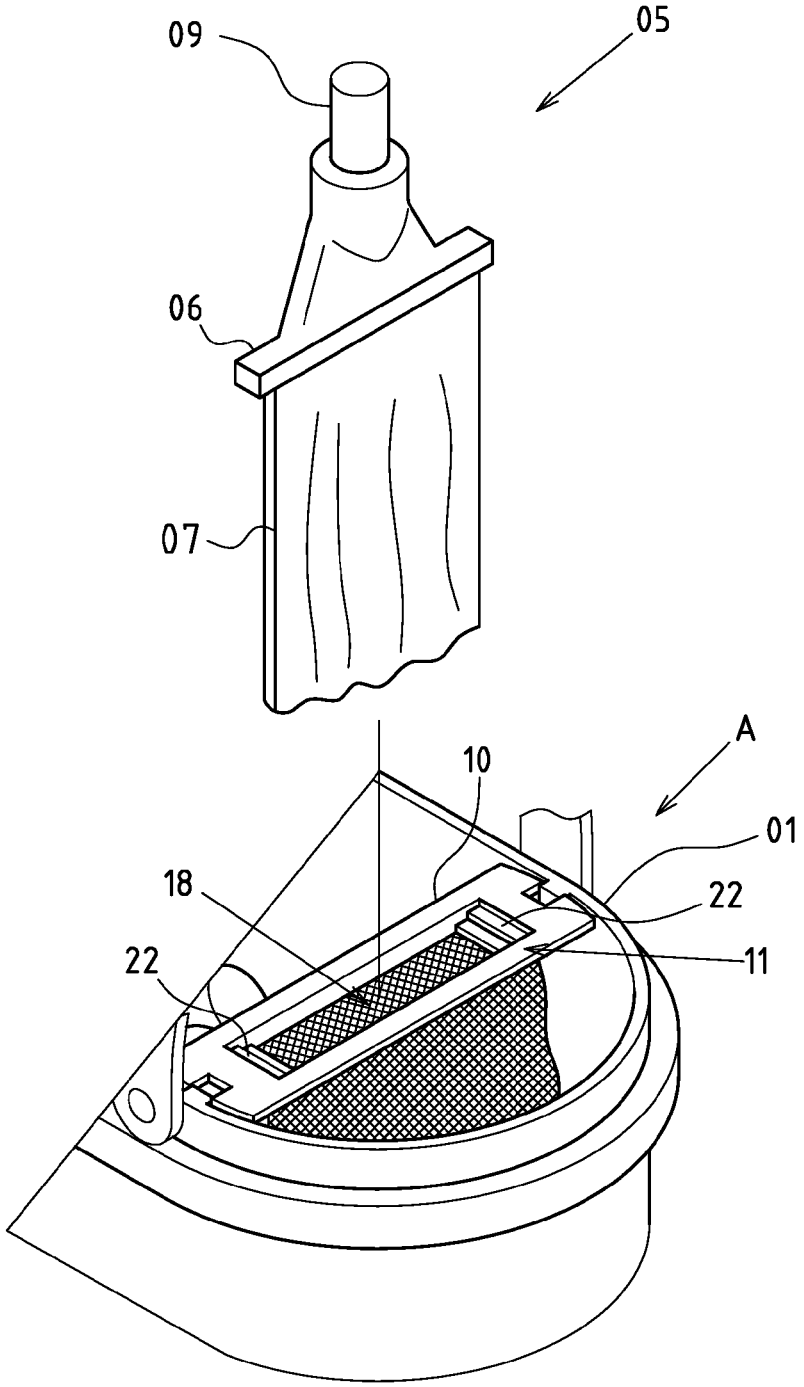
FIG. 3 shows an embodiment of the present invention wherein the mop tip inserting portion matches a mop with a flat tip.

Particularly, the fixing seat 10 can be in the form of a plate, and the mop tip inserting portion 11 can be in any type of a round-shaped, long-shaped, or round hole going through the center of the fixing seat 10, to match various existing types of mop 05. FIGS. 2 and 3 depict a preferred embodiment of the present invention, wherein the mop tip inserting portion 11 is a long-shaped hole going through the center of the fixing seat 10, to match a flat-shaped tip 06 of an existing mop. Or, the fixing seat 10 can also be in the form of a frame, and the hollow part formed inside the frame-shaped fixing seat 10 constitutes the mop tip inserting portion 11, to match various existing mop types (Figure of such an embodiment is omitted).

Referring to FIG. 3, the mop tip inserting portion 11 is further arranged with a positioning edge 22 to match the tip 06 of the mop 05, so that the tip 06 of the mop 05 can be supported and fixed when inserted into the mop tip inserting portion 11.

Referring to FIG. 2, the bucket 01 can be further arranged with a water discharge outlet 23, so as to discharge the water wrung out from the mop 05. In actual applications, a plug can be used to block the water discharge outlet 23, and at this time, clean water can be poured into the bucket 01 to wash the mop 05. Later, the plug can be removed to discharge the dirty water after the washing (Figure of such an embodiment is omitted).

Figure 5:
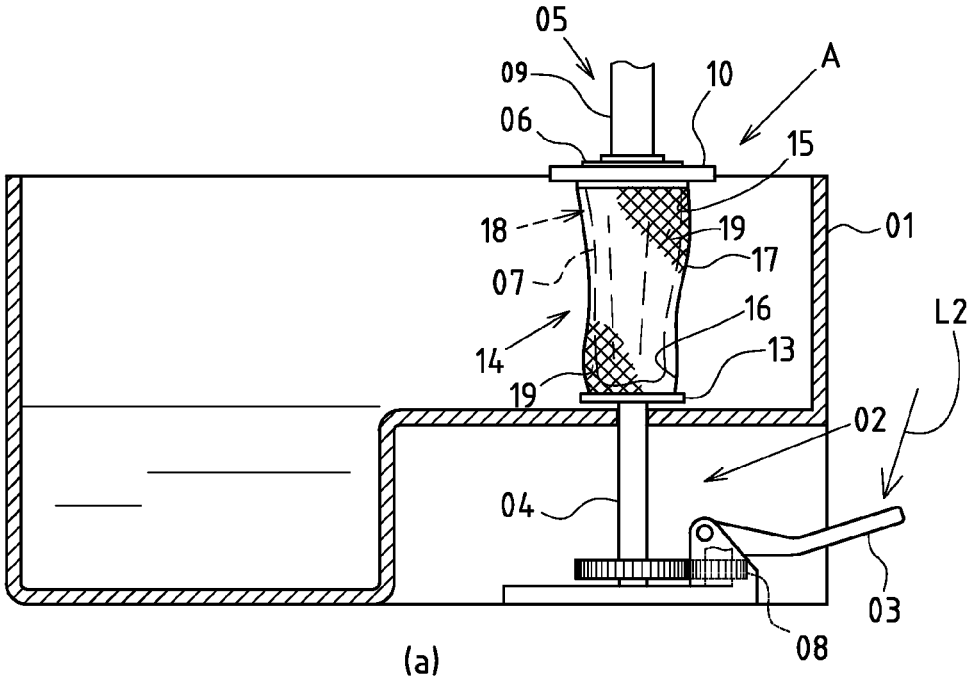
FIGS. 5(*a*) and 5(*b*) are schematic views showing the operation of the mop wringer of the present invention to wring and dry the mop.
Figure 5:
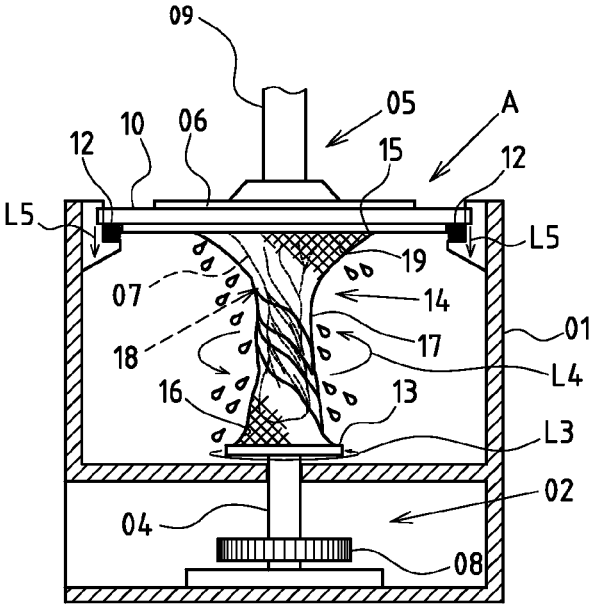
Figure 6:
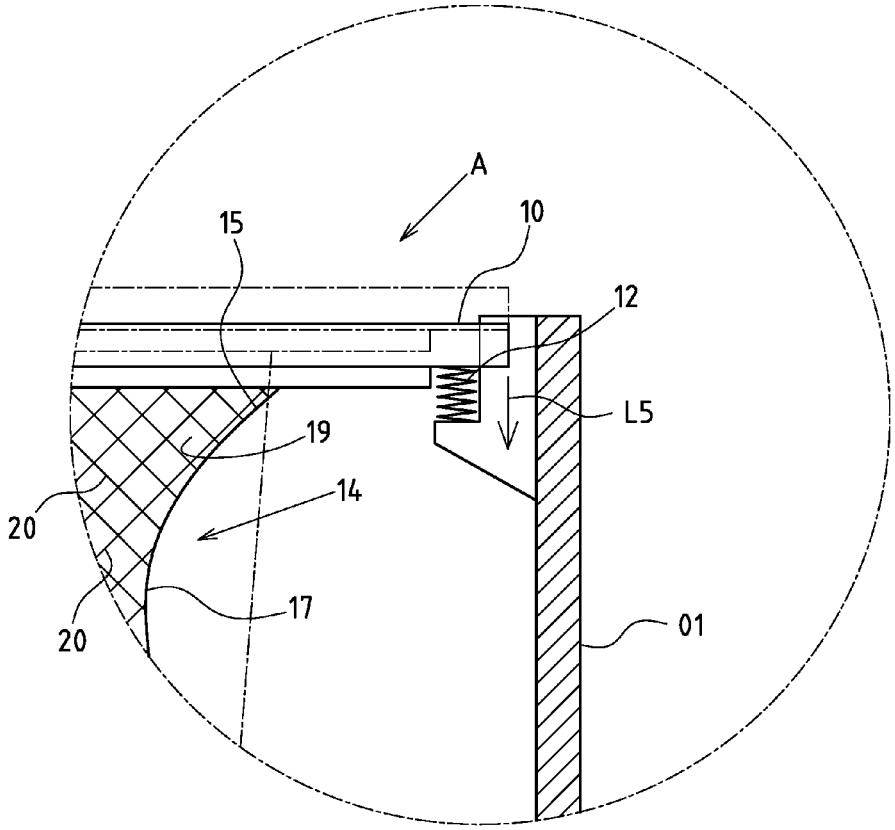
FIG. 6 is a partially enlarged view of FIG. 5.

Based on the afore-mentioned structural design, the operation of the present invention is as described below:

Referring to FIGS. 3 and 4, firstly, the washed mop 05 is inserted through the mop tip inserting portion 11 (marked by Arrow L1 in FIG. 4), the tip 06 of the mop 05 can be supported and positioned against the positioning edge 22 (marked in FIGS. 1-3), and the cloth straps 07 of the tip 06 of the mop 05 are held inside the mop holding space 18 of the wringing portion 14 (as shown in FIG. 5 (*a*)). At this point, by treading the driving piece 03 (marked by Arrow L2 in FIG. 5 (*a*)), as shown in FIG. 5(*b*), the gear transmission assembly 08 can be driven to rotate and drive the guide piece 04 and rotary disc 13 to rotate (as marked by Arrow L3). In this way, the wringing portion 14 can have a twisting movement (marked by Arrow L4), and meanwhile, the cloth straps 07 of the mop 05 held inside the mop holding space 18 will have a twisting and rolling movement along with the wringing portion 14. As a result, the water contained in the cloth straps 07 can be wrung out through the twisting and squeezing, and the water can flow out from the water discharge portion 19. Thus, an ideal degree of dryness of the mop 05 can be achieved in a reliable and effective way.

Referring to FIG. 5 (*b*), when the cloth straps 07 are twisted and rolled up under the rotation force from the wringing portion 14, the length of the cloth straps 07 will be relatively shortened comparing to the untwisted state (refer to the comparison between FIGS. 5 (*a*) and (*b*)), causing a force to pull the mop 05 downward. If the tip 06 of the mop 05 is in a fixed state, it will have a resistance against the twisting and rolling of the cloth straps 07, so that the cloth straps 07 can not continue to be twisted. Hence, based on the technical characteristics of the present invention that an elastic supporting piece 12 is configured between the fixing seat 10 and the bucket 01, when the cloth straps 07 is in a twisted and rolled-up state, the tip 06 of the mop 05 will elastically move downward (as marked by Arrow L5, detailed in FIG. 6, which is a partially enlarged view of FIG. 5 (*b*)), so that the cloth straps 07 can be smoothly twisted and wrung to dry.

I claim:

1. A mop wringing apparatus comprising:

a mop bucket having a driving device affixed thereto, said driving device having a driving piece and a guide piece; and a mop wringer attached in a position on said mop bucket, said mop wringing apparatus comprising:

a fixing seat attached to at least a portion of a top end of said mop bucket;

a mop tip inserting portion formed as a hollow space across a portion of said fixing seat;

a rotary disc positioned on a bottom of said mop bucket and connected to said guide piece of said driving device such that said driving device can rotate said rotary disc; and a wringing portion of a ring shape, said wringing portion connected between said fixing seat and said rotary disc, said wringing portion having an open upper end and a lower open end and a periphery and a mop holding space, said upper open end connected to said fixing seat, said lower open end connected to said rotary disc, said periphery having a plurality of water discharge portions.

2. The mop wringing apparatus of claim 1, said fixing seat and said mop bucket connected by an elastic supporting piece such that said fixing seat is elastically supported such that said fixing seat is elastically supported upwardly.

3. The mop wringing apparatus of claim 1, further comprising:

a carrying handle pivotally connected to said top end of said mop bucket, said carrying handle having a snap button at a position corresponding to said mop tip inserting portion.

4. The mop wringing apparatus of claim 1, said periphery of said wringing portion having a permeable net formed of crisscrossed cords.

5. The mop wringing apparatus of claim 1, said periphery of said wringing portion having straps in longitudinally spaced relationship.

6. The mop wringing apparatus of claim 1, said fixing seat being a plate, said mop tip inserting portion being a hole formed in a center of said plate.

7. The mop wringing apparatus of claim 1, said mop bucket having a water discharge outlet.

* * * * *